US010711683B2

(12) United States Patent
Arnold et al.

(10) Patent No.: US 10,711,683 B2
(45) Date of Patent: Jul. 14, 2020

(54) METHOD AND APPARATUS FOR COOLING AN ENGINE

(71) Applicant: IAV GmbH Ingenieurgesellschaft Auto und Verkehr, Berlin (DE)

(72) Inventors: Thomas Arnold, Mitteldorf (DE); Ingo Friedrich, Kleinmachnow (DE)

(73) Assignee: IAV GMBH INGENIEURGESELLSCHAFT AUTO UND VERKEHR, Berlin (DE)

( * ) Notice: Subject to any disclaimer, the term of this patent is extended or adjusted under 35 U.S.C. 154(b) by 0 days.

(21) Appl. No.: 16/386,291

(22) Filed: Apr. 17, 2019

(65) Prior Publication Data

US 2019/0353082 A1 Nov. 21, 2019

(30) Foreign Application Priority Data

May 16, 2018 (DE) ..... 10 2018 111 704

(51) Int. Cl.
*F01P 3/22* (2006.01)
*F01P 11/02* (2006.01)

(52) U.S. Cl.
CPC ..... *F01P 3/22* (2013.01); *F01P 11/0295* (2013.01); *F01P 2003/225* (2013.01); *F01P 2060/14* (2013.01)

(58) Field of Classification Search
CPC .... F01P 3/22; F01P 11/0295; F01P 2003/225; F01P 2060/14; F01P 2025/32; F01P 2025/04; F01P 7/16; F01P 11/18
See application file for complete search history.

(56) References Cited

U.S. PATENT DOCUMENTS 4,630,573 A * 12/1986 Ogawa ..... F01P 11/18 123/41.27
4,667,626 A 5/1987 Hayashi et al.
4,681,179 A * 7/1987 Hayashi ..... B60K 11/04 123/41.21
4,788,943 A 12/1988 Hayashi
(Continued)

FOREIGN PATENT DOCUMENTS

DE 3615974 A1 12/1986
DE 3339717 C2 1/1990
(Continued)

*Primary Examiner* — Hung Q Nguyen
*Assistant Examiner* — Brian P Monahon
(74) *Attorney, Agent, or Firm* — Leydig, Voit & Mayer, Ltd.

(57) ABSTRACT

A method for cooling an engine includes increasing the pressure of a liquid coolant from a first pressure to a second pressure. Thereafter, components of the engine to be cooled are contacted with the liquid coolant so that the liquid coolant at least partially evaporates and forms a vapor with a particular state. Thereafter, the vapor is fed to a throttle to reduce the pressure of the liquid coolant to a third pressure. The particular state of the vapor is determined based on the temperature and the third pressure of the liquid coolant downstream of the throttle, and based on the second pressure of the liquid coolant under an assumption that the throttle is an adiabatic throttle such that enthalpy of the liquid coolant remains constant as the liquid coolant passes the throttle. A desired vapor state adjustment is made based on the determined particular state of the vapor.

7 Claims, 2 Drawing Sheets

(56) References Cited

U.S. PATENT DOCUMENTS

| | | | | |
|---|---|---|---|---|
| 2004/0221660 | A1* | 11/2004 | Dutton | G01F 1/74 73/861.354 |
| 2005/0198983 | A1* | 9/2005 | Bruzzo | B60H 1/3202 62/238.3 |
| 2009/0166175 | A1* | 7/2009 | Waibel | B01D 3/007 203/49 |
| 2010/0122671 | A1* | 5/2010 | Lee | F01P 7/14 123/41.1 |
| 2011/0056675 | A1* | 3/2011 | Barringer | H05K 7/20736 165/299 |
| 2012/0198868 | A1* | 8/2012 | Huff | F25B 41/043 62/115 |
| 2013/0319097 | A1* | 12/2013 | Yamashita | F02G 5/02 73/114.68 |
| 2014/0116374 | A1* | 5/2014 | Brown | F02M 25/03 123/25 C |
| 2016/0084202 | A1* | 3/2016 | Brown | F02M 25/03 60/599 |

FOREIGN PATENT DOCUMENTS

| | | | |
|---|---|---|---|
| DE | 4342473 | A1 | 6/1995 |
| DE | 102017102893 | A1 | 8/2018 |
| JP | 11200889 | A | 7/1999 |

* cited by examiner

METHOD AND APPARATUS FOR COOLING AN ENGINE

CROSS-REFERENCE TO PRIOR APPLICATION

Priority is claimed to German Patent Application No. DE 10 2018 111 704.3, filed on May, 16, 2018, the entire disclosure of which is hereby incorporated by reference herein.

FIELD

The present invention relates to a method and apparatus for cooling an engine.

BACKGROUND

It is the state of the art, for example, in accordance with DE 33 39 717 A1, to achieve the cooling of an internal combustion engine by means of evaporation of a cooling agent. The temperature of a component on the combustion chamber side can be recorded by means of a sensor, and the vapor pressure can be regulated as a function thereof. In this way, an adjustment of the cooling of the internal combustion engine to changing operating conditions is possible within a limited scope. If the internal combustion engine becomes, for example, only a little loaded, then a higher component temperature is suitable, which can be adjusted by increasing the vapor pressure.

An efficient evaporation cooling is then particularly possible when a specific vapor state is present. This is, in practice, a state within the wet vapor area. For example, wet vapor with a residual moisture of around 5 percent may be optimal (x=0.95). That is, overheating of the vapor should be avoided. Overheating primarily results in a low heat transfer, which would make the cooling of an engine less economical. This is due to such a procedure (with overheating) resulting in high wall temperatures as well as unfavorable thermal gradients in the range of final boiling point and start of overheating. Excessive component loads and potential damage can therefore not be excluded. In order to influence or adjust the desired vapor state, it is necessary to regularly provide, in any case, for the delivery of a given amount of coolant in a wide range of varying dissipating heat with regard to the operation of an engine. In summary, the knowledge of the instantaneous vapor state is essential for an optimal evaporation cooling of an engine. With pressure and temperature sensors, this state in the wet vapor area cannot, or cannot satisfactorily, be determined. That is, it is thus not possible to unequivocally determine which state the cooling fluid is in, i.e., whether it is close to the liquid state or near the gaseous state. It would be conceivable to implement a slight overheating at the outlet, i.e., downstream of the engine to be cooled, so that the energetic state can always be determined explicitly. However, as stated, overheating is detrimental to economical and safe cooling.

SUMMARY

In an embodiment, the present invention provides a method for cooling an engine. The pressure of a liquid coolant is increased from a first pressure to a second pressure. After increasing the pressure of the liquid coolant, components of the engine to be cooled with the liquid coolant are contacted with the liquid coolant so that the liquid coolant at least partially evaporates and forms a vapor with a particular state. After the vapor with the particular state forms, the vapor is fed to a throttle so as to reduce the pressure of the liquid coolant to a third pressure. The particular state of the vapor upstream of the throttle is determined based on the temperature and the third pressure of the liquid coolant downstream of the throttle, and based on the second pressure of the liquid coolant upstream of the throttle under an assumption that the throttle is an adiabatic throttle such that enthalpy of the liquid coolant remains constant as the liquid coolant passes the throttle. A desired vapor state adjustment is made based on the determined particular state of the vapor upstream of the throttle.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Embodiments of the present invention provide for the cooling of an engine economically and safely. This is achieved according to embodiments of the invention in that, for the purpose of an as optimal as possible evaporation cooling of an engine, on the basis of the temperature and the pressure of a coolant, which, following the absorption of heat of the engine, passes a throttle arranged downstream of the engine, and by means of the pressure of the coolant upstream of this throttle, the current state of the coolant or of the coolant vapor is determined, wherein the configuration of a desired vapor state is achieved by means of the thus determined state of the vapor upstream of the throttle.

According to embodiments of the invention, the current vapor state of the cooling agent can thus be determined with sufficient accuracy for an optimal evaporative cooling.

Since the current vapor state is thus known, overheating, especially, can be avoided, and a transferred mass flux of cooling agent can be optimally adjusted, or the required power for a delivery can be minimized.

Furthermore, according to another embodiment of the invention, an apparatus for the implementation of the described methods will be made available.

Further advantageous embodiments of the present invention can be gathered from the following design example.

Figure 1:
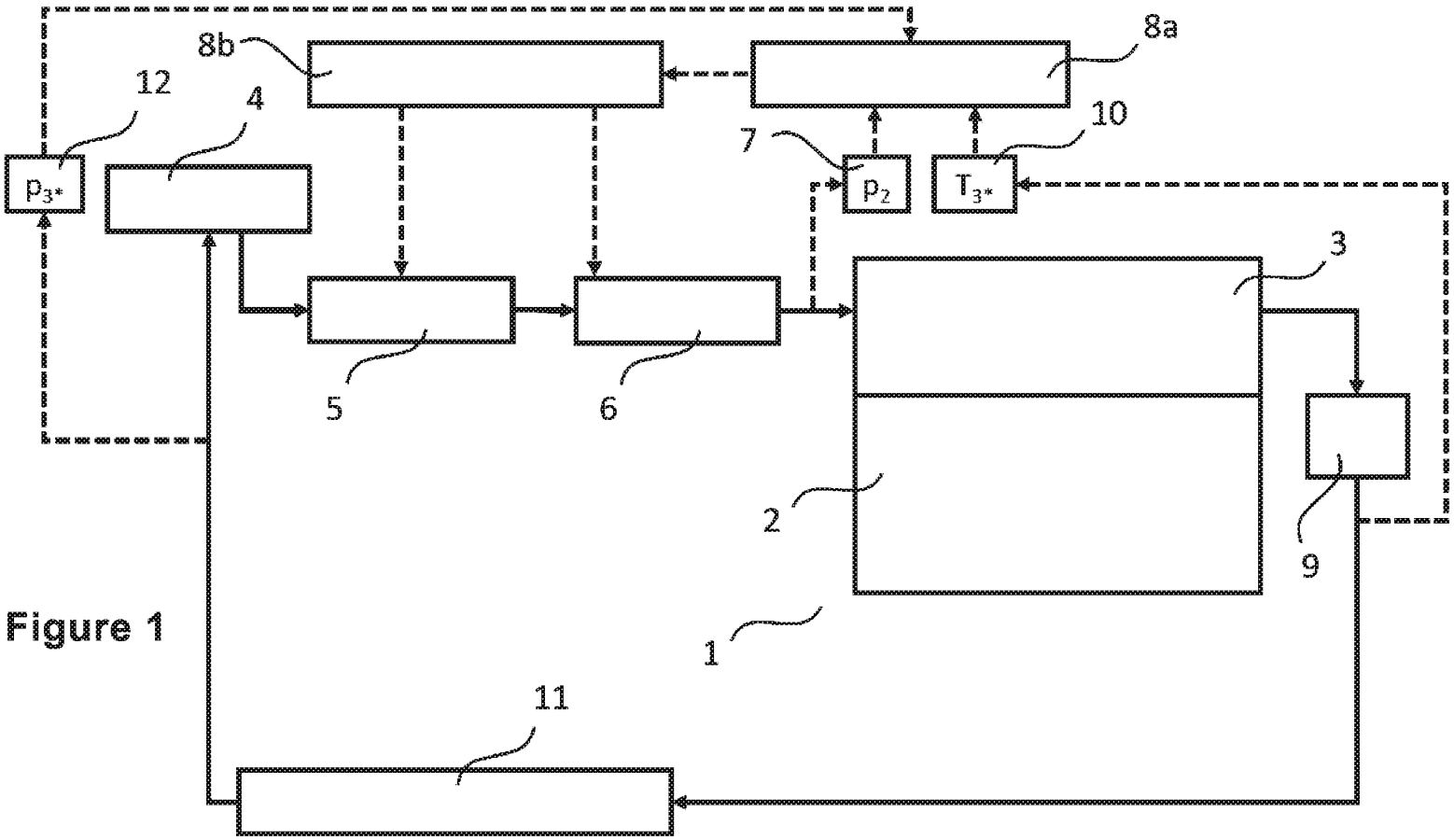
FIG. 1 schematically shows the cooling system of an engine in accordance with an embodiment of the present invention.

According to FIG. 1, the cooling system of an engine 1 is shown—especially, for driving a vehicle. The engine 1 is preferably an internal combustion engine 1. However, it can also be an electric machine 1. The internal combustion engine 1 includes an engine block 2 and a cylinder head 3. Coolant contained in a tank 4 is conveyed by means of a first pump 5 to a second pump 6. The coolant/cooling fluid is, in particular, a mixture of water and ethanol. The first pump 5 is a pre-feed pump, and the second pump 6 is a high-pressure pump. By means of the second pump 6, the pressure of the conveyed coolant from the first pump 5 is increased from a pressure in a range between 2 to 3 bar to a pressure $p_2$ in a range between 10 to 60 bar. The pressure $p_2$ downstream of the second pump 6 in the region (possibly inside) of the internal combustion engine 1 is detected by means of a sensor 7. The first pump 5 and/or the second pump 6 are controlled and/or regulated in conjunction with a control unit 8*a*, 8*b* on the basis of the pressure $p_2$ and/or on the basis of other/further factors specified more precisely in the further course. In particular, an adjustment of the conveyed quantity of coolant and/or of the pressure $p_2$ is made therewith. The control unit 8*a* is, in particular, a common control unit for signal processing/provision, and the control unit 8*b* is used to provide control (PWM) signals regarding the first pump 5 and/or the second pump 6. The coolant with a pressure $p_2$ in a range between 10 to 60 bar is contacted for the purpose of cooling the internal combustion engine 1 to the engine block 2 and/or the cylinder head 3. In doing so, a phase transition of the coolant takes place at least partially. In particular, a wet vapor is formed. The actual vapor state initially remains unknown. In the further course, this vapor, still unknown, is supplied to a throttle valve/expansion valve/throttle 9. The throttle 9 corresponds, in particular, to a pressure regulating valve. In any case, a cross-section in the previously undefined coolant line results from the throttle 9, which can be immediately and clearly seen by a professional in FIG. 1. This cross-sectional narrowing causes an approximately isenthalpic pressure reduction of a coolant flow to a pressure $p_{3*}$. By passing the throttle 9, a temperature $T_{3*}$ of the reduced pressure, now completely gaseous coolant is made. The temperature $T_{3*}$ is detected by means of a sensor 10. The pressure p2 detected by means of the sensor 7 and the temperature T3* detected by means of the sensor 10 are each supplied to the control unit 8*a*. In the further course, the coolant flow is liquefied by means of a condenser 11. The coolant is supplied to tank 4 again and is available there (for a further cycle). As shown in FIG. 1, the pressure $p_{3*}$ of the coolant downstream of the throttle 9 is also detected by means of a sensor 12. The pressure $p_{3*}$ of the coolant can be detected downstream of the throttle 9 and downstream of the capacitor 11, or downstream of the throttle 9 and upstream of the capacitor 11.

Figure 2:
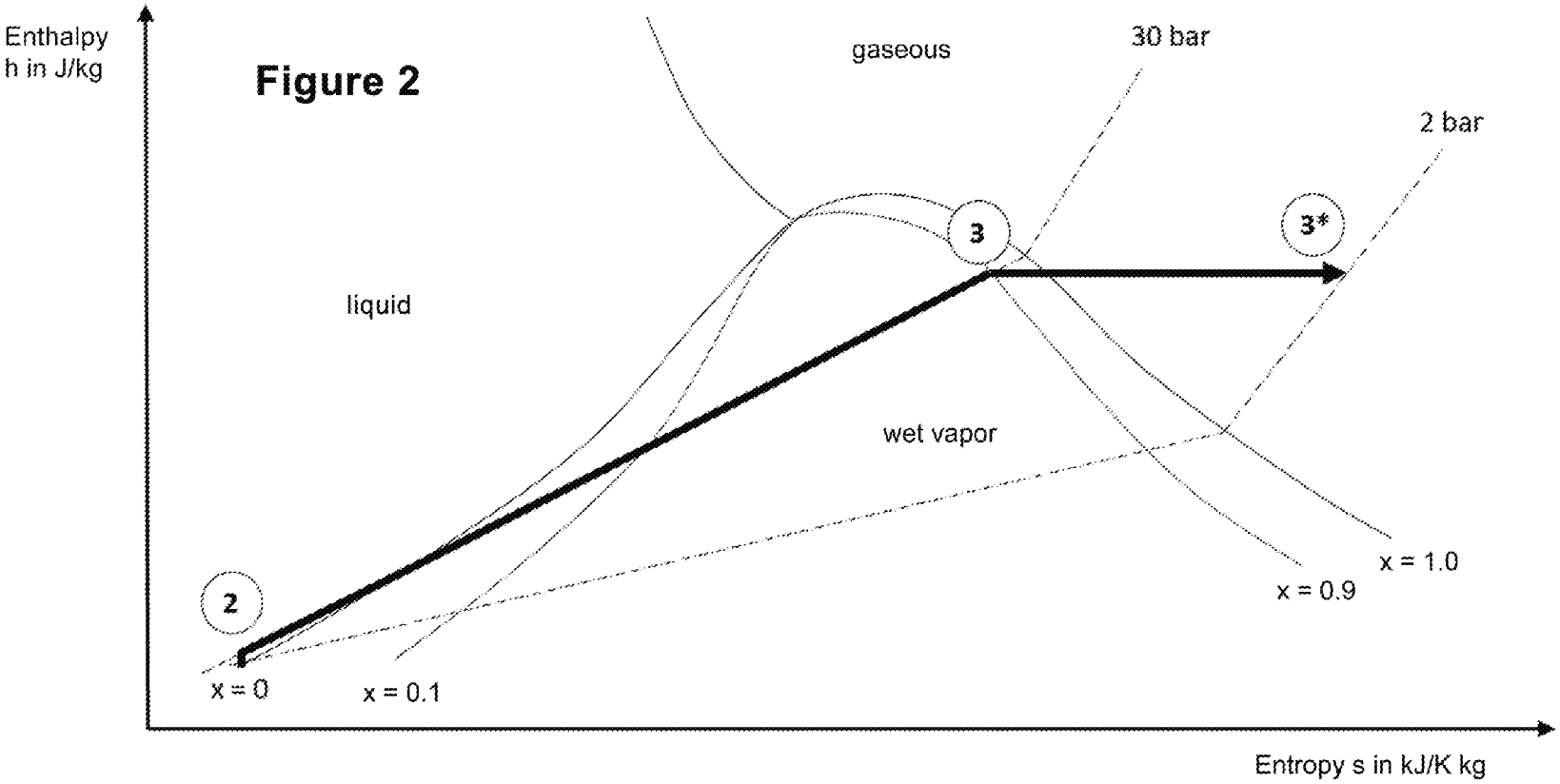
FIG. 2 schematically shows the relevant physical relationships in an h-s-diagram.

According to an embodiment of the invention, the determination of the vapor phase as described in connection with FIG. 2 is made. FIG. 2 schematically shows the relevant physical relationships in an h-s-diagram (Mollier enthalpy entropy diagram). The coolant is initially liquid (x=0). In connection with increasing the pressure of the coolant by means of the second pump 6 to a pressure $p_2$ at a height of 30 bar, a certain change in the specific enthalpy h is made; see state 2 in FIG. 2. Through the contact of the coolant with the engine block 2 and/or the cylinder head 3 for the purpose of cooling the internal combustion engine 1, both the specific enthalpy h as well as the specific entropy s of the coolant is increased from the state 2 in the further course at a constant pressure $p_2$ amounting to 30 bar. As shown in FIG. 2, wet vapor is formed ($0<x<1$).

In state 3, there is, in any case, a wet vapor with a residual moisture of around 10% (x=0.9). However, this vapor state cannot naturally be determined by the pressure and temperature measurement, since there is no unique relationship. In addition, the temperature $T_3$ may be determined to be satisfactory or unsatisfactory by means of temperature sensors within the engine 1, i.e., inside the engine block 2 and/or inside the cylinder head 3.

In the further course, the vapor is supplied to the throttle 9, and a throttling process takes place, wherein a state 3* is established downstream of the throttle 9, which is characterized by a pressure $p_{3*}$ at the level of 2 bar and a specific entropy s of the coolant increased relative to the state 3 and a temperature $T_{3*}$.

Based on the measurements of the temperature $T_{3*}$ detected by sensor 10 and the pressure $p_{3*}$ detected by sensor 12, it is now possible, according to an embodiment of the invention, to determine, in conjunction with the pressure $p_2$ detected by sensor 7 downstream of the second pump 6—assuming that throttle 9 is an (ideal) adiabatic, isenthalpic throttle—the state 3 of the coolant or the condition of the vapor inside the engine 1 or upstream of the throttle 9 (sufficiently accurate).

In particular, downstream of the throttle 9, the specific enthalpy $h_{3*}$ of the coolant is dependent upon the temperature $T_{3*}$ detected by means of the sensor 10 and dependent upon the pressure $p_{3*}$ detected by means of the sensor 12. In other words, the specific enthalpy $h_{3*}$ of the coolant, on the basis of this measurement, can be determined—in particular, computationally or by means of a suitable calculation specification and/or in conjunction with one or more characteristics/maps stored, for example, in one of the control units 8*a*, 8*b*. In other words, this enthalpy $h_{3*}=f(T_{3*}, p_{3*})$.

Because the enthalpy h of the cooling fluid when passing the throttle 9 remains approximately constant (the pressure is reduced without removal of work and idealized even without removal of heat, i.e., thermodynamically isenthalpically), the (specific) enthalpy $h_{3*}$ of the coolant downstream of the throttle 9 in state 3* corresponds to the enthalpy $h_3$ of the coolant upstream of the throttle 3 in state 9.

The state 3 of the coolant or the vapor state $x_3$ to be determined is again dependent on the (specific) enthalpy $h_3$ of the coolant, which, according to an embodiment of the invention, is presumed to be consistent with the (specific) enthalpy $h_{3*}$ of the coolant downstream of the throttle 9 in state 3* and dependent on the pressure $p_2$ detected by means of the sensor 7. In other words, the vapor state $x_3$ or the state 3 of the coolant can be determined on the basis of this refinement—in particular, computationally or by means of a suitable computing rule and/or in conjunction with one or more characteristic curves/maps which are stored in one of the control units 8*a*, 8*b*, for example. In other words the vapor state $x_3$ is $=f(h_3, p_2)$, where $h_3$, according to an embodiment of the invention, equates to $h_{3*}$.

In other words, a determination of the vapor state $x_3$ is achieved with the aid of:

the temperature $T_{3*}$ detected by means of the sensor 10 downstream of the throttle 9 and with the aid of:

the pressure $p_{3*}$ detected by means of the sensor 12 downstream of the throttle 9 and with the aid of:

the pressure $p_2$ detected by means of the sensor 7 downstream of the second pump 6, and assuming that the throttle 9 is an ideal throttle or is an adiabatic throttle, which instigates an isenthalpic change in state, wherein the (specific) enthalpy $h_{*3}$ downstream of the throttle 9 is set to equal the (specific) enthalpy $h_3$ upstream of the throttle 9.

According to an embodiment of the invention, a vapor state $x_{3_soll}$ can now be specified as the reference variable, wherein a control compares this reference variable with a control variable for the purpose of creating a control difference, wherein the control variable equates to the determined vapor state according to an embodiment of the invention $x_3=f(h_3, p_2)$, in the formation of which the (specific) enthalpy $h_3$ upstream of the throttle 9, according to an embodiment of the invention, is set equal to the specific enthalpy $h_3$ downstream of the throttle 9. Depending on the system deviation, it is controlled using an adjuster to affect the system. The system to be regulated here is the cooling system of the engine 1, and the actuator is/are, in particular, the first pump 5 and/or the second pump 6. In particular, an adjustment of the conveyed amount of coolant and/or of the pressure $p_2$ is made for the adjustment of the desired vapor state $x_{3_soll}$ by means of one of these actuators or both actuators together, so that an optimal utilization of the conveyed coolant can take place or as little energy as possible is required for operating the first pump 5 and/or the second pump 6.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A method for cooling an engine, the method comprising:

increasing the pressure of a liquid coolant from a first pressure to a second pressure;

after increasing the pressure of the liquid coolant, contacting components of the engine to be cooled with the liquid coolant so that the liquid coolant at least partially evaporates and forms a vapor with a particular state;

after the vapor with the particular state forms, feeding the vapor to a throttle so as to reduce the pressure of the liquid coolant to a third pressure;

determining the particular state of the vapor upstream of the throttle based on the temperature and the third pressure of the liquid coolant downstream of the throttle, and based on the second pressure of the liquid coolant upstream of the throttle under an assumption that the throttle is an adiabatic throttle such that enthalpy of the liquid coolant remains constant as the liquid coolant passes the throttle; and adjusting a desired vapor state based on the determined particular state of the vapor upstream of the throttle.

2. The method according to claim 1, wherein the adjustment of the desired vapor state is performed using at least one pump which adjusts a conveyed quantity of coolant.

3. The method according to claim 1, wherein the determination of the particular state of the vapor upstream of the throttle includes, initially, determining the enthalpy of the liquid coolant downstream of the throttle based on the temperature of the liquid coolant downstream of the throttle as detected by a first sensor, and based on the third pressure of the liquid coolant downstream of the throttle as detected by a second sensor, and, subsequently, equating the enthalpy upstream of the throttle with the enthalpy downstream of the throttle so as to determine the particular state of the vapor upstream from the throttle using the enthalpy and the second pressure of the liquid coolant upstream of the throttle as determined by a third sensor.

4. The method according to claim 1, wherein the engine is an internal combustion engine or an electric machine.

5. The method according to claim 1, wherein the liquid coolant is a mixture of water and ethanol.

6. An apparatus configured to carry out the method according to claim 1.

7. A vehicle comprising the apparatus according to claim 6.

* * * * *